United States Patent [19]

Braun et al.

[11] 4,124,170

[45] Nov. 7, 1978

[54] HORIZONTAL-TYPE SINGLE TOGGLE JAW BREAKER

[75] Inventors: Ernst Braun; Gert Braun, both of Essen-Heisingen, Germany

[73] Assignee: Halbach & Braun, Germany

[21] Appl. No.: 814,837

[22] Filed: Jul. 11, 1977

[30] Foreign Application Priority Data

Jul. 28, 1976 [DE] Fed. Rep. of Germany ..... 2633798

[51] Int. Cl.[2] ..... B02C 1/04

[52] U.S. Cl. ..... 241/265; 241/267

[58] Field of Search ..... 241/262–269

[56] References Cited

U.S. PATENT DOCUMENTS

| | | | |
|---|---|---|---|
| 962,998 | 6/1910 | Christ et al. | 241/262 X |
| 3,330,490 | 7/1967 | Cowher, Jr. | 241/267 X |
| 3,763,772 | 10/1973 | Baker | 241/267 X |

FOREIGN PATENT DOCUMENTS

| | | | |
|---|---|---|---|
| 1,100,431 | 2/1961 | Fed. Rep. of Germany | 241/265 |
| 724,883 | 2/1955 | United Kingdom | 241/267 |

*Primary Examiner*—Howard N. Goldberg
*Attorney, Agent, or Firm*—McGlew and Tuttle

[57] ABSTRACT

A horizontal-type single toggle jaw breaker for crushing medium to large size materials, for example, coal and other minerals, which are advanced on a conveyor having an upper reach and a lower reach, comprises a fixed jaw mounted over the upper strand with a pivotal jaw mounted for pivotal movement alongside the fixed jaw pivoting about a substantially vertical axis. A toggle joint has a drive portion connected to the pivotal jaw which includes a drive motor and a transmission with an output shaft which is connected to the toggle joint through an eccentric. In addition, a flywheel is disposed between the upper and lower reaches of the conveyor and it includes a flywheel shaft having a gear thereon which is driven from an intermediate gear driven off the output shaft of the transmission.

8 Claims, 2 Drawing Figures

2

HORIZONTAL-TYPE SINGLE TOGGLE JAW BREAKER

FIELD AND BACKGROUND OF THE INVENTION

This invention relates in general to material crushers and, in particular, to a new and useful horizontal-type single toggle jaw breaker for crushing medium to large size materials, particularly coal and other minerals, on the upper strand or reach of a conveyor, preferably a chain scraper conveyor, which has a stationary breaking jaw and a breaking jaw swinging horizontally about a vertical axis of rotation over the upper strand, which is supported in the range of the end of its axis of rotation by means of toggle joints, and connected with its working end to an eccentric drive including a driving motor, a transmission, an eccentric shaft and a crank shaft as an energy accumulator.

DESCRIPTION OF THE PRIOR ART

Single toggle jaw breakers are known wherein a disk flywheel is arranged directly on the eccentric shaft, while a connecting rod, actuated by the eccentric shaft, acts on the swinging breaking jaw. This design is disadvantageous for many reason, in particular, it is unsuitable for use in underground mining because the flywheel, which is secured on the horizontal eccentric shaft, is rather high, particularly since the eccentric shaft rotates at a relatively low speed and the flywheel must therefore have a large diameter if a feasible flywheel mass is to be available as an energy accumulator, taking into account the given speed. In addition, the connecting rod transmits the breaking forces or moments produced during the breaking by the swinging breaking jaw directly to the transmission or introduces the breaking forces or moments over the eccentric shaft directly into the transmission and thus the transmission is highly stressed and is soon subject to damages.

SUMMARY OF THE INVENTION

The present invention provides a horizontal-type single toggle jaw breaker which is characterized by a particularly compact design and is therefore highly suitable for use in underground mines. The device has an eccentric drive which is designed in such a manner that the breaking forces or moments are absorbed before they enter the transmission of the eccentric drive.

According to the invention, a single toggle jaw breaker is constructed so that an intermediate gear is arranged between the vertical eccentric shaft and the transmission, and the flywheel disc is arranged horizontally between the upper and lower reach of the conveyor on an intermediate shaft branched off from the transmission. According to the teaching of the invention, a horizontal-type single toggle jaw breaker is thus provided where not only are the jaw breakers arranged horizontally, but the flywheel of the eccentric drive is also arranged horizontally. This results in a particularly compact and flat design. In addition, the breaking forces or moments appearing on the breaking jaws of the single toggle jaw breaker according to the invention are absorbed by the intermediate gear, so that the transmission is no longer subject to extreme stresses and damages. The interposition of the intermediate gear has the effect that the intermediate shaft with the flywheel can have a much higher speed of rotation than the following eccentric shaft, so that the flywheel can have a relatively small diameter, despite the increased speed, and still have a sufficient flywheel mass to be able to serve as an energy accumulator. The interpostion of the intermediate gear has several advantages due to supplemental technical effects which lead to a horizontal-type single toggle jaw breaker which is highly suitable for use in underground mining due to its compact and rugged construction.

The intermediate gear is arranged preferably between the transmission and the flywheel. The transmission is arranged above the intermediate gear and the flywheel below the intermediate gear, so that the intermediate gear is arranged partially between the transmission and the flywheel to absorb breaking forces or moments. The driving motor and the transmission are preferably arranged in tandem in a longitudinal direction next to the conveyor on a widening of the spout plate which results in a flat and narrow design.

According to the invention, the flywheel is braced by means of a floor-side mounting against the bottom plate aligned with the bottom edge of the lower strand so as not to impart the support of the conveyor and the moving operation. Though the flywheel is arranged horizontally between the upper stand and the lower strand of the conveyor, according to the teaching of the invention, it cannot be accommodated completely between the upper and the lower strand, but only partially, because the eccentric must be arranged laterally of the conveyor. This has the result that a part of the disc projects laterally from the conveyor. According to the teaching of the invention, the part of the disc flywheel which projects laterally from the conveyor is arranged in a protective housing consisting of a lateral increase of the spout plate, a lateral increase of the bottom plate, and a jacket which connects the two. In this way, accidents to operating personnel can be avoided.

Accordingly, it is an object of the invention to provide a horizontal-type single toggle jaw breaker for crushing medium to large size materials, for example, coal and other minerals, which are moved along a conveyor which has an upper reach and a lower reach and which comprises a fixed jaw mounted over the upper reach of the conveyor with a pivotal jaw mounted alongside the fixed jaw and driven by an eccentric drive to move toward and away from the fixed jaw and, wherein, the eccentric drive includes a transmission having an output shaft with an eccentric drive to a toggle link connection to the pivotal jaw for pivoting the jaw and which further includes a flywheel which is disposed between the upper and lower reaches of the conveyor which has a flywheel shaft with a flywheel gear thereon which is driven by an intermediate gear which is carried on the output shaft.

A further object of the invention is to provide a horizontal-type single toggle jaw breaker which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
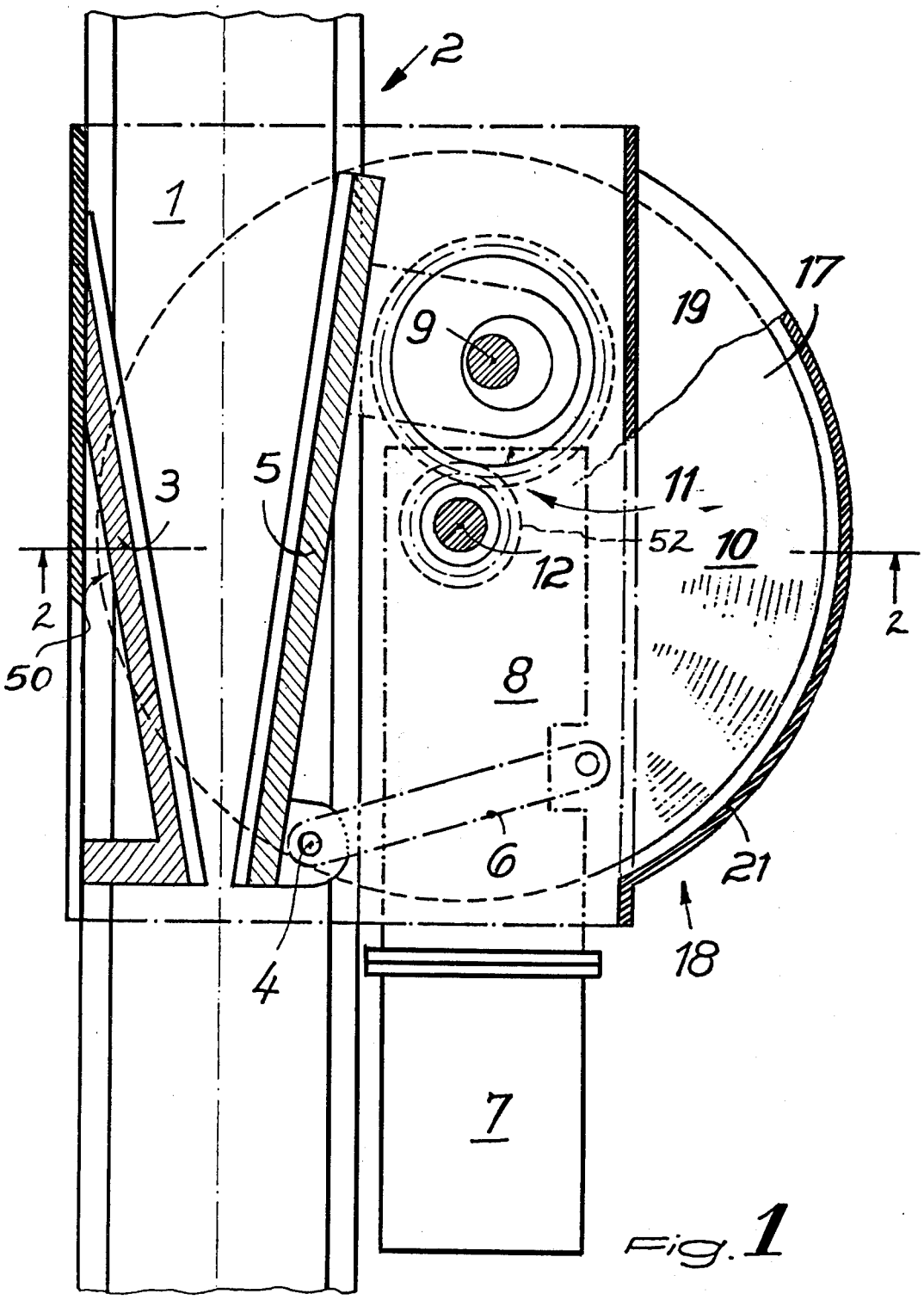
FIG. 1 is a partial top plan view, partly in section, of a single toggle jaw breaker, constructed in accordance with the invention.
Figure 2:
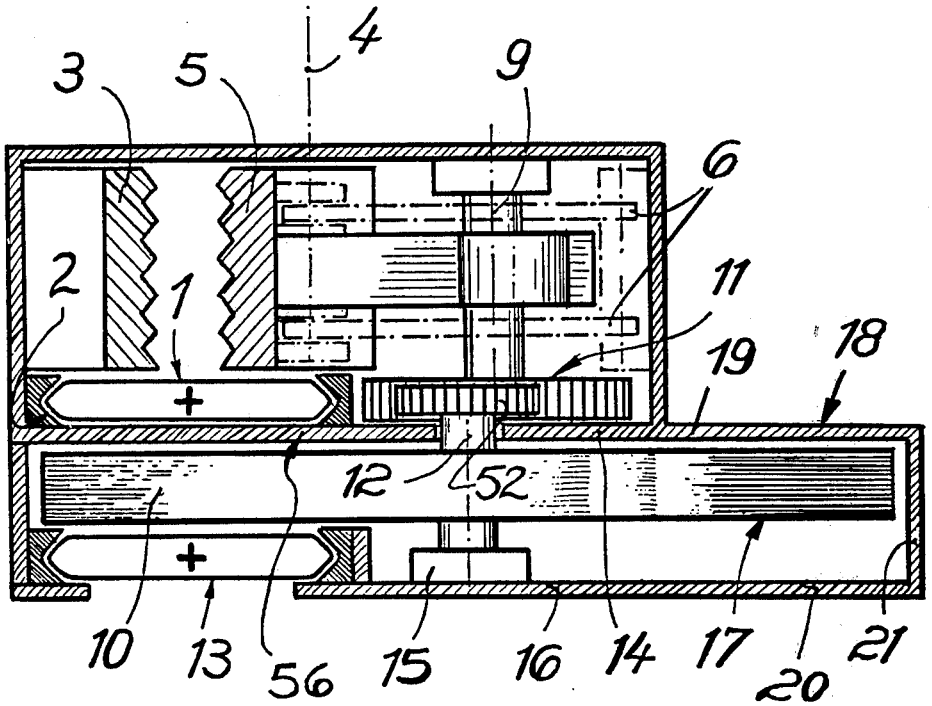
FIG. 2 is a vertical section taken through the line 2—2 of FIG. 1.

Referring to the drawings in particular, the invention embodied therein, comprises a horizontal-type single toggle jaw breaker, generally designated 50, which is used in association with a coal conveyor, generally designated 2 and which, in accordance with the invention, includes a flywheel 10 disposed between the upper and lower strands 1 and 13 of the conveyor 2.

The drawings show a horizontal-type single toggle jaw breaker, generally designated 50, for crushing medium to large size materials, particularly coal or other minerals on an upper reach or strand 1 of a conveyor 2, in particular, a chain scraper conveyor.

The material to be crushed is fed along the upper strand 1 of the conveyor 2 and it moves between the jaws 3 and 5 and is crushed by the cooperative movement of the jaw 5 in respect to the jaw 3. A construction similar to this is described for example in German Pat. No. 1,100,431.

The jaw breaker 50 includes a stationary breaking jaw 3 and a breaking jaw 5 horizontally pivotable about a vertical axis of rotation 4 over the upper reach 1. The jaw breaker 50 is supported by means of toggle joints 6 in the range of the end of its axis of rotation and the joint 6 is connected at its driving end to an eccentric drive including a driving motor 7, a transmission 8, an eccentric shaft 9 and a flywheel 10 as an energy accumulator. An intermediate gear 11 is arranged between the vertical eccentric shaft 9 and transmission 8. The flywheel 10 is arranged horizontally between upper stand 1 and lower strand 13 of the conveyor 2 on an intermediate shaft 12 which carries a gear 52 driven by gear 11 from transmission 8. Intermediate gear 11 is arranged between transmission 8 and flywheel 10. Transmission 8 can be arranged above intermediate gear 11, and flywheel 10 can be arranged below the intermediate gear 11, so that the intermediate gear is in between. Driving motor 7 and transmission 8 are arranged in tandem in a longitudinal direction adjacent conveyor 2 in a widening 14 of the spout plate 56. Intermediate gear 11 is arranged above, and flywheel 10 below, the widening 14. Flywheel 10 bears through its shaft 12 on a floor-side mounting 15 against a bottom plate 15 aligned with the underside of lower strand 13. The part 17 of flywheel 10 projecting from conveyor 2 laterally is accommodated in a protective housing 18 formed of a lateral extension 19 of the spout plate 56, a lateral extension 20 of the bottom plate 16 and of a jacket 21 which connects the two.

While a specific embodiment of the invention has been shown and described in detail to illustrate the application of the principles of the invention, it will be understood that the invention may be embodied otherwise without departing from such principles.

What is claimed is:

1. The horizontal type single-toggle jaw breaker for crushing medium to large sized material such as coal comprising a conveyor having an upper strand on which the material is moved and a lower strand extending below said upper strand, a stationary breaking jaw disposed alongside and extending upwardly over said upper strand in a position to contact material fed thereon, a movable breaking jaw cooperable with said stationary breaking jaw to crush material fed on said conveyor therebetween, said movable breaking jaw having respective first and second opposite ends, pivotal means pivotally mounting said movable braking jaw adjacent its first end for pivotal movement about a substantially vertical axis next to said fixed jaw, a toggle joint having a drive portion connected to said movable braking jaw at a location spaced from said second end, drive means for pivoting said movable braking jaw including a substantially vertical drive shaft, a substantially vertical eccentric shaft connected to said drive shaft and eccentrically moved thereby for pivotally moving said movable breaking jaw, and a flywheel affixed to said drive shaft for rotation therewith and disposed horizontally between said upper and lower strands.

2. A horizontal type single-toggle jaw breaker for crushing coal and other minerals on a conveyor having an upper reach over which the material is fed and a lower reach, comprising a fixed jaw mounted over the upper reach in a position to engage the material advanced thereby, a pivotal jaw adjacent said fixed jaw and cooperable therewith to crush the material fed on said conveyor therebetween and having one end and an opposite end alongside said fixed jaw, means pivotally mounting said pivotal jaw adjacent its one end for pivotal movement about a substantially vertical axis next to said fixed jaw, a toggle joint having a drive portion connected to said pivotal jaw at a location spaced from said pivotal mounting means and adjacent said opposite end for the pivoting of said pivotal jaw, a drive connection to said toggle joint including a drive motor, a transmission connected to said drive motor and having a rotatable output shaft driven by said motor, an eccentric connected to said output shaft and to said toggle joint to pivot said pivotal jaw, a flywheel rotatably mounted adjacent said transmission between the upper and lower reaches and having a flywheel shaft, a flywheel gear on said flywheel shaft, and an intermediate gear on said output shaft in meshing engagement with said flywheel gear to rotate said flywheel.

3. A horizontal-type single toggle jaw breaker, according to claim 2, wherein said intermediate gear is interposed between said transmission and said flywheel.

4. A horizontal-type single toggle jaw breaker, according to claim 2, wherein said transmission is arranged above said intermediate gear and said flywheel is arranged below said intermediate gear.

5. A horizontal-type single toggle jaw breaker, according to claim 2, wherein said driving motor and said transmission are arranged in tandem in a longitudinal direction next to said conveyor, a spout plate extending outwardly from said conveyor and forming a bearing boss for said flywheel, said spout plate having a widening exteriorly of said conveyor enclosing said flywheel.

6. A horizontal-type single toggle jaw breaker, according to claim 2, wherein said intermediate gear is arranged above said flywheel, the conveyor housing for the conveyor having a spout plate extending outwardly from below the upper reach of said conveyor, said flywheel having a shaft, said flywheel shaft journalled in said spout plate, said spout plate having a widening exteriorly of said conveyor enclosing said flywheel, and said intermediate gear being arranged above the flywheel in the widening of said spout plate.

7. A horizontal-type single toggle jaw breaker, according to claim 2, including a conveyor housing for the conveyor comprising a bottom plate and a spout plate spaced vertically upwardly from said bottom plate, said flywheel shaft being journalled in said spout plate and supported on said bottom plate.

8. A horizontal-type single toggle jaw breaker, according to claim 7, wherein said housing includes an end plate enclosing said housing and covering said flywheel, with a jacket portion extending between said spout plate and said bottom plate.

* * * * *